US010854018B2

(12) United States Patent
Novak

(10) Patent No.: US 10,854,018 B2
(45) Date of Patent: Dec. 1, 2020

(54) DETERMINING AN AMOUNT FOR A TOLL BASED ON LOCATION DATA POINTS PROVIDED BY A COMPUTING DEVICE

(71) Applicant: Uber Technologies, Inc., San Francisco, CA (US)

(72) Inventor: Kevin Mark Novak, San Francisco, CA (US)

(73) Assignee: Uber Technologies, Inc., San Francisco, CA (US)

( * ) Notice: Subject to any disclaimer, the term of this patent is extended or adjusted under 35 U.S.C. 154(b) by 813 days.

(21) Appl. No.: 15/647,064

(22) Filed: Jul. 11, 2017

(65) Prior Publication Data

US 2017/0309083 A1 Oct. 26, 2017

Related U.S. Application Data

(63) Continuation of application No. 13/830,538, filed on Mar. 14, 2013, now abandoned.

(51) Int. Cl.
*G07B 15/02* (2011.01)
*G07B 15/06* (2011.01)

(52) U.S. Cl.
CPC ..... *G07B 15/02* (2013.01); *G07B 15/063* (2013.01)

(58) Field of Classification Search
CPC ..... G07B 15/02; G07B 15/063
See application file for complete search history.

(56) References Cited

U.S. PATENT DOCUMENTS 5,394,333 A * 2/1995 Kao ..... G01C 21/30 340/990
5,694,322 A 12/1997 Westerlage et al.
5,724,660 A * 3/1998 Kauser ..... G01C 21/20 342/451
5,767,505 A * 6/1998 Mertens ..... G07B 15/063 235/61 S (Continued)

FOREIGN PATENT DOCUMENTS

CN 1800783 A 7/2006
CN 101136140 A 3/2008

(Continued)

OTHER PUBLICATIONS

Mattias Eliasson, "A Kalman filter approach to reduce position error for pedestrian applications in areas of bad GPS reception", published by UMEA University, in 2014 (Year: 2014).*

(Continued)

*Primary Examiner* — Omar Zeroual
(74) *Attorney, Agent, or Firm* — Fenwick & West LLP

(57) ABSTRACT

A method for calculating a fare for a transport service is provided. One or more processors receive a plurality of location data points from a computing device associated with a vehicle providing the transport service. The plurality of location data points correspond to a route of travel during performance of the transport service. A determination is made, based on a set of location data points of the plurality of location data points, that the vehicle has potentially driven along a roadway in which a toll is to be assessed as part of the fare. The roadway in which the toll is to be assessed is identified. The amount for the toll is determined for the identified roadway.

10 Claims, 5 Drawing Sheets

(56) References Cited

U.S. PATENT DOCUMENTS 5,828,979 A 10/1998 Polivka et al.
5,864,831 A * 1/1999 Schuessler ..... G06Q 20/127 705/13
6,002,981 A 12/1999 Kreft
6,109,525 A * 8/2000 Blomqvist ..... G08G 1/015 235/384
6,175,800 B1 * 1/2001 Mori ..... G01C 21/3679 340/995.19
6,179,252 B1 1/2001 Roop et al.
6,184,802 B1 2/2001 Lamb
6,236,933 B1 5/2001 Lang
6,243,657 B1 6/2001 Tuck et al.
6,401,034 B1 6/2002 Kaplan et al.
6,421,587 B2 7/2002 Diana et al.
6,429,808 B1 * 8/2002 King ..... G01S 19/07 342/357.44
6,456,207 B1 * 9/2002 Yen ..... G08G 1/202 235/384
6,459,385 B2 * 10/2002 Yamashita ..... G07B 15/063 340/928
6,484,094 B1 11/2002 Wako
6,574,557 B2 * 6/2003 Endo ..... G01S 19/22 342/357.29
6,631,322 B1 10/2003 Arthur et al.
6,658,392 B2 * 12/2003 Yoshida ..... G06Q 20/206 235/384
6,791,475 B2 * 9/2004 Yamashita ..... G07B 15/063 235/384
6,892,942 B1 * 5/2005 Widl ..... G08G 1/017 235/384
6,985,812 B2 * 1/2006 Sweetapple ..... G01S 19/21 342/357.31
7,009,501 B2 3/2006 Olch
7,095,370 B1 * 8/2006 van Diggelen ..... G01S 19/22 342/357.61
7,143,241 B2 11/2006 Hull
7,177,614 B2 * 2/2007 Agarwal ..... G01S 19/21 455/272
7,233,799 B2 * 6/2007 Spain, Jr. ..... H04W 64/00 455/456.1
7,382,275 B2 * 6/2008 Feldman ..... G07B 15/00 340/426.16
7,421,334 B2 9/2008 Dahlgren et al.
7,487,108 B2 * 2/2009 Aoki ..... G06Q 10/08 705/13
7,525,427 B2 4/2009 Mauriello
7,545,287 B2 * 6/2009 Feldman ..... G07B 15/063 340/10.1
7,561,068 B1 * 7/2009 Denker ..... G08G 1/096716 340/988
7,590,490 B2 9/2009 Clark
7,630,918 B2 * 12/2009 Gila ..... G06Q 20/10 705/1.1
7,692,655 B2 4/2010 Ni
7,698,450 B2 4/2010 Monroe et al.
7,714,705 B2 5/2010 Rennie et al.
7,720,581 B2 * 5/2010 Yaqub ..... H04W 4/029 701/32.3
7,733,371 B1 6/2010 Monroe
7,783,516 B2 * 8/2010 Stoffelsma ..... G06Q 20/045 705/17
7,835,749 B1 * 11/2010 Hart ..... G01S 5/0252 455/446
7,839,328 B2 * 11/2010 Kimura ..... G01S 19/29 342/357.25
7,957,871 B1 6/2011 Echeru
7,979,292 B2 * 7/2011 Hamilton, II ..... G06Q 50/14 705/5
8,188,745 B2 5/2012 Overby et al.
8,378,815 B1 * 2/2013 McNulty ..... G06Q 10/0833 340/539.13
8,473,203 B2 6/2013 Shin et al.
8,519,771 B1 8/2013 Cical et al.
8,587,454 B1 * 11/2013 Dearworth ..... G07B 15/063 340/928
8,732,000 B2 * 5/2014 Tijink ..... G06Q 30/0284 705/13
8,890,746 B2 * 11/2014 Alizadeh-Shabdiz ..... G01S 19/48 342/357.23
9,053,633 B2 * 6/2015 Breed ..... G08G 1/0175
9,151,619 B2 * 10/2015 Venkatraman ..... G01S 19/28
9,269,197 B2 * 2/2016 Van Haperen ..... G07B 15/063
9,277,525 B2 * 3/2016 Dupray ..... G01S 5/02
9,366,764 B2 * 6/2016 Sun ..... G01S 19/49
9,439,167 B2 * 9/2016 MacDonald ..... H04L 43/16
9,665,991 B2 * 5/2017 Simanek ..... G06Q 30/0251
9,691,188 B2 * 6/2017 Breed ..... G07B 15/00
9,759,800 B2 * 9/2017 Potkonjak ..... H04W 16/28
9,909,885 B2 * 3/2018 Boss ..... G06Q 30/0283
9,934,619 B2 * 4/2018 Brands ..... G07B 15/063
10,032,181 B1 * 7/2018 Madhow ..... H04W 4/029
10,121,289 B1 * 11/2018 Gravelle ..... G07B 15/063
10,650,621 B1 * 5/2020 King ..... H04W 4/40
2001/0025251 A1 * 9/2001 Konishi ..... G07B 15/063 705/13
2002/0005801 A1 * 1/2002 Lyusin ..... G01S 5/0045 342/357.48
2002/0042269 A1 * 4/2002 Cotanis ..... G01S 5/0252 455/423
2002/0145541 A1 * 10/2002 Matsui ..... G08G 1/017 340/934
2003/0146871 A1 * 8/2003 Karr ..... G01S 5/02 342/457
2003/0164796 A1 * 9/2003 Needham ..... H04N 1/32101 342/357.46
2003/0189498 A1 * 10/2003 Kakihara ..... G07B 15/02 340/928
2004/0203436 A1 * 10/2004 Oesterling ..... H04B 17/20 455/67.11
2004/0227616 A1 * 11/2004 Lafferty ..... G07B 15/063 340/5.61
2005/0097018 A1 * 5/2005 Takida ..... G07C 5/008 705/35
2005/0216187 A1 * 9/2005 Hartinger ..... G06Q 30/0284 701/468
2005/0258978 A1 * 11/2005 Hartinger ..... G01C 21/26 340/928
2006/0079248 A1 4/2006 Otsuka et al.
2006/0176849 A1 * 8/2006 Gass ..... H04W 64/00 370/328
2006/0200379 A1 * 9/2006 Biet ..... G07B 15/063 705/13
2006/0229778 A1 10/2006 Obradovich et al.
2006/0258367 A1 * 11/2006 Chiang ..... G07B 15/063 455/456.1
2007/0152878 A1 * 7/2007 Wang ..... G01S 19/34 342/357.63
2007/0275731 A1 * 11/2007 Alfert ..... G07C 5/085 455/456.1
2008/0040210 A1 * 2/2008 Hedley ..... G06Q 20/10 705/13
2008/0195428 A1 * 8/2008 O'Sullivan ..... G06Q 10/025 705/6
2008/0262722 A1 * 10/2008 Haag ..... G01C 21/3626 701/412
2009/0138199 A1 * 5/2009 Bonanni ..... G01C 21/165 701/472
2009/0157566 A1 * 6/2009 Grush ..... G07B 15/063 705/400
2009/0231193 A1 * 9/2009 Bu ..... G01S 19/29 342/357.68
2009/0234523 A1 9/2009 Nandedkar
2009/0262014 A1 * 10/2009 DiEsposti ..... G01S 19/25 342/357.42
2009/0322605 A1 * 12/2009 Farmer ..... G01S 19/34 342/357.31
2010/0076878 A1 * 3/2010 Burr ..... G08G 1/20 705/34

(56) References Cited

U.S. PATENT DOCUMENTS

2010/0109948 A1* 5/2010 Razoumov ..... G01S 19/48 342/357.28
2010/0114475 A1* 5/2010 Shin ..... G01C 21/30 701/533
2010/0141261 A1 6/2010 Overby et al.
2010/0161392 A1* 6/2010 Ashby ..... G06Q 30/0284 705/13
2010/0176940 A1* 7/2010 Saidi ..... G01S 5/0278 340/539.13
2010/0228608 A1* 9/2010 Hedley ..... G06K 9/00798 705/13
2010/0287038 A1* 11/2010 Copejans ..... G07B 15/063 705/13
2011/0060600 A1* 3/2011 Fox ..... G01S 19/51 705/1.1
2011/0102258 A1* 5/2011 Underbrink ..... H04B 1/707 342/357.47
2011/0131238 A1* 6/2011 Peeters ..... G07B 15/063 707/769
2011/0136468 A1* 6/2011 McNamara ..... G06Q 20/16 455/406
2011/0153267 A1* 6/2011 Peeters ..... G07B 15/02 702/150
2011/0257882 A1* 10/2011 McBurney ..... G01S 19/47 701/532
2011/0282717 A1* 11/2011 Aschenbrenner .... G07B 15/063 705/13
2011/0291881 A1* 12/2011 Shirai ..... G01S 19/22 342/357.25
2011/0298658 A1* 12/2011 Riley ..... G01S 19/39 342/357.26
2012/0058775 A1* 3/2012 Dupray ..... H04W 4/029 455/456.1
2012/0163662 A1* 6/2012 Lee ..... G06K 9/00651 382/103
2012/0185302 A1* 7/2012 Kim ..... G06Q 30/06 705/13
2012/0209519 A1* 8/2012 Basnayake ..... G01S 5/0072 701/457
2012/0215594 A1* 8/2012 Gravelle ..... G07B 15/02 705/13
2012/0232800 A1 9/2012 Overby et al.
2012/0232964 A1 9/2012 Brands
2012/0249368 A1* 10/2012 Youssef ..... G01S 19/24 342/357.31
2012/0299702 A1* 11/2012 Edara ..... G01S 19/49 340/8.1
2012/0313817 A1* 12/2012 Underbrink ..... G01S 19/24 342/357.72
2012/0323642 A1* 12/2012 Camp ..... G06Q 10/06 705/13
2013/0006725 A1* 1/2013 Simanek ..... G07B 15/063 705/13
2013/0018705 A1* 1/2013 Heath ..... G08G 1/207 705/13
2013/0084847 A1* 4/2013 Tibbitts ..... H04W 4/029 455/419
2013/0099963 A1* 4/2013 Wu ..... G01S 19/05 342/357.29
2013/0110685 A1* 5/2013 Dempski ..... H04W 4/029 705/30
2013/0151138 A1* 6/2013 Lu ..... G09B 29/106 701/410
2013/0165143 A1* 6/2013 Ziskind ..... G06N 20/00 455/456.1
2013/0185123 A1* 7/2013 Krivopaltsev ..... G06Q 50/30 705/13
2013/0185124 A1 7/2013 Aaron et al.
2013/0212176 A1* 8/2013 Koulomzin ..... G06Q 50/01 709/204
2013/0219429 A1 8/2013 Hirsch et al.
2013/0278466 A1* 10/2013 Owen ..... G01S 19/071 342/464
2013/0282236 A1* 10/2013 Kato ..... G08G 1/163 701/36
2013/0342396 A1* 12/2013 O'Connor ..... G01S 19/05 342/357.42
2014/0018095 A1* 1/2014 Parvizi ..... H04W 4/029 455/456.1
2014/0087754 A1* 3/2014 Siomina ..... H04W 4/029 455/456.1
2014/0113619 A1* 4/2014 Tibbitts ..... B60W 40/09 455/419
2014/0141796 A1* 5/2014 Marti ..... H04W 4/021 455/456.1
2014/0155098 A1* 6/2014 Markham ..... H04B 1/0064 455/456.3
2014/0171114 A1* 6/2014 Marti ..... H04W 64/00 455/456.2
2014/0171118 A1* 6/2014 Marti ..... H04W 4/021 455/456.3
2014/0274031 A1* 9/2014 Menendez ..... H04W 52/0209 455/426.1
2014/0365488 A1* 12/2014 Arslan ..... G06F 16/275 707/736
2015/0153459 A1* 6/2015 Shim ..... G01S 19/40 342/357.23
2015/0189467 A1* 7/2015 Alsehly ..... G01S 5/0236 455/456.1
2015/0281884 A1* 10/2015 Smith ..... G01S 5/0263 455/456.3
2015/0287422 A1* 10/2015 Short ..... G10L 13/02 704/205
2015/0301189 A1* 10/2015 Berchin ..... G01S 19/40 342/357.23
2015/0348409 A1* 12/2015 Lykkja ..... G07B 15/063 342/357.52
2015/0369924 A1* 12/2015 Hedgecock ..... G01S 5/0072 342/357.34
2016/0029155 A1* 1/2016 Kerr ..... H04W 4/029 455/456.3
2017/0169363 A1* 6/2017 Salmasi ..... H04W 4/21
2018/0302740 A1* 10/2018 Tseng ..... G01S 5/021
2018/0359165 A1* 12/2018 Frydman ..... G01S 13/765
2019/0012657 A1* 1/2019 Geist ..... G08G 1/017
2019/0227176 A1* 7/2019 Song ..... B60W 40/105
2019/0287388 A1* 9/2019 Salti ..... G01S 19/52

FOREIGN PATENT DOCUMENTS

CN 102087709 A 6/2011
CN 102128626 A 7/2011
CN 102183256 A 9/2011
CN 102435197 A 5/2012
WO WO 2008/145986 12/2008

OTHER PUBLICATIONS

Jacek Czajewski, "The Accuracy of the Global Positioning Systems", published by IEEE instrumentation & Measurement Magazine, in 2004 (Year: 2004).*
John Krumm, "Map matching with travel time constraints", published by SAE international in 2006 (Year: 2006).*
Chinese Second Office Action, Chinese Application No. 201480026212.5, dated Oct. 16, 2017, 50 pages.
Goh, et al., Online map-matching based on Hidden Markov model for real-time traffic sensing applications, 2012, www.mit.edu/-jaillet/general/map_matching_itsc2012-final.pdf.
Krum et al., Map Matching with Travel Time Constraints, 2006 SAE International.
Office Action, U.S. Appl. No. 13/830,538, dated Apr. 27, 2015, 14 pages.

(56) References Cited

OTHER PUBLICATIONS

Office Action, U.S. Appl. No. 13/830,538, dated Oct. 2, 2014, 9 pages.

* cited by examiner

DETERMINING AN AMOUNT FOR A TOLL BASED ON LOCATION DATA POINTS PROVIDED BY A COMPUTING DEVICE

CROSS-REFERENCE TO RELATED APPLICATIONS

This application is a continuation of U.S. application Ser. No. 13/830,538, filed Mar. 14, 2013, which is incorporated by reference in its entirety.

BACKGROUND OF THE INVENTION

On-demand transport services exist that can arrange transport for users. In some cases, the service provider, such as a driver for a transport or delivery service, must travel along a route that requires the service provider to pay a toll.

DETAILED DESCRIPTION

Figure 1:
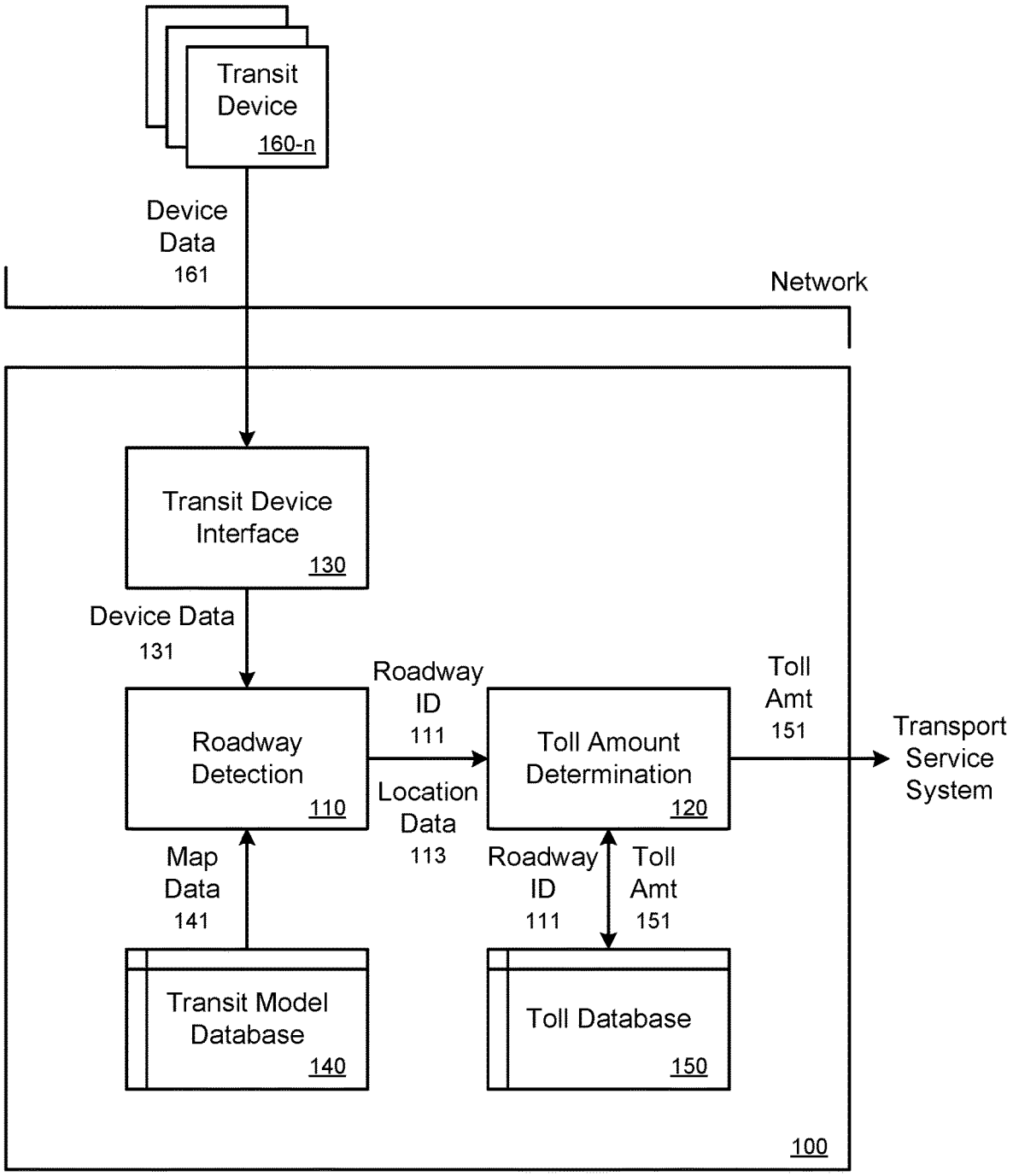
FIG. 1 illustrates an example tolling system for determining an amount for a toll for a transport service.

Embodiments described herein provide for a system that can determine when a service provider has driven through a tunnel or along a roadway in which a toll is to be assessed, based on location data received from a computing device associated with the service provider. The system can then identify which tunnel (as well as which direction) the service provider has driven through in order to properly assess the correct amount for the toll. In one example, the system can communicate with or be part of a transport service system that arranges for transport between a requester and a service provider, so that the system can provide the amount for the toll to the transport service system for purposes of calculating the total fare.

In one implementation, the system can receive (e.g., periodically) location data points (e.g., global positioning system (GPS) data) from one or more computing devices over a network. The one or more computing devices can correspond to transit devices, or devices that are associated with a service provider and/or a respective vehicle. The location data points can provide an indication of the route of travel of the vehicle during performance of the transport or delivery service. Based on a set of location data points, the system can determine whether the vehicle has potentially traveled along a roadway in which a toll is to be assessed.

In some situations, during performance of the transport service, a vehicle may travel along a roadway in an area where a computing device loses service (e.g., no cellular service) or provides inaccurate GPS data. For example, the vehicle may travel in a rural area where cellular service is weak, or may travel underground or underwater through a tunnel. Despite not receiving location data (or receiving inaccurate location data) for a period of time, the system can determine, based on location data that has been received, whether the vehicle has potentially traveled along a roadway or through a tunnel in which a toll is to be assessed. In response to determining that the vehicle has potentially driven along a roadway or through a tunnel in which a toll is to be assessed, the system can identify the most probable roadway or tunnel that the vehicle has driven on.

According to examples, the system can perform a lookup, e.g., in a transit system database, for one or more roadways in which a toll is to be assessed that are within a predetermined distance of one or more location data points received from the transit device. When there are two or more candidate roadways or tunnels in an area (e.g., such as in an urban region), the system determine which roadway was most likely traveled by the vehicle. In one implementation, the system can also extrapolate additional data points, e.g., when there is a loss of location data points, to determine the most likely or probable roadway or tunnel the vehicle traveled through during performance of the transport service.

Based on the identified roadway or tunnel, the system can determine an amount for the toll. In one example, the system can look up the identified roadway or tunnel in a database, such as a toll database that includes entries of roadways in which a toll is to be assessed with their corresponding amounts (e.g., five dollars, or an amount per mile driven). The system can provide the amount to the transport service system so that the amount can be charged as part of the fare to the customer who received the transport service.

As described herein, a "user," a "requester," or a "customer" is invariably used to refer to individuals that are requesting or ordering a service. Also as described herein, a "provider," a "service provider," a "supplier," or a "vendor" is invariably used to refer to individuals or entities that can provide the service. In addition, as described herein, a "customer device" or "transit device" refers to computing devices, such as desktop computers, cellular or smartphones, laptop computers, tablet devices, television (IP Television), taxi meters, etc., that can provide network connectivity and processing resources for enabling a customer or service provider to communicate with a system (and/or the transport service system) over one or more networks (e.g., a cellular network).

Examples described herein provide that methods, techniques, and actions performed by a computing device are performed programmatically, or as a computer-implemented method. Programmatically, as used herein, means through the use of code or computer-executable instructions. These instructions can be stored in one or more memory resources of a computing device or a wireless access point. A programmatically performed step may or may not be automatic.

One or more examples described herein can be implemented using programmatic modules or components. A programmatic module or component can include a program, a sub-routine, a portion of a program, or a software component or a hardware component capable of performing one or more stated tasks or functions. As used herein, a module or component can exist on a hardware component independently of other modules or components. Alternatively, a module or component can be a shared element or process of other modules, programs or machines.

Some examples described herein can generally require the use of computing devices, including processing and memory resources. For example, one or more examples described herein may be implemented, in whole or in part, on computing devices, such as mobile computing devices, access points, desktop computers, cellular or smart phones, laptop computers, servers, or routers. Memory, processing, and network resources may all be used in connection with the establishment, use, or performance of any example described herein (including with the performance of any method or with the implementation of any system).

Furthermore, one or more examples described herein may be implemented through the use of instructions that are executable by one or more processors. These instructions may be carried on a computer-readable medium. Machines shown or described with figures below provide examples of processing resources and computer-readable mediums on which instructions for implementing examples described herein can be carried and/or executed. In particular, the numerous machines or devices shown with examples herein include processor(s) and various forms of memory for holding data and instructions. Examples of computer-readable mediums include permanent memory storage devices, such as hard drives on personal computers or servers. Other examples of computer storage mediums include portable storage units, such as CD or DVD units, flash memory (such as carried on smart phones, multifunctional devices or tablets), and magnetic memory. Computers, terminals, network enabled devices (e.g., mobile devices, PCs, televisions) are all examples of machines and devices that utilize processors, memory, and instructions stored on computer-readable mediums. Additionally, some examples may be implemented in the form of computer-programs, or a computer usable carrier medium capable of carrying such a program.

System Description

FIG. 1 illustrates an example tolling system for determining an amount for a toll for a transport service. A tolling system, such as system 100 as described in FIG. 1, can be implemented in a variety of computing environments. System 100 (and one or more of its components) can be implemented using memory and processing resources of one or more computing devices. For example, system 100 can be implemented through a combination of servers or other network-enabled computing devices. In other variations, system 100 can be implemented on other computing platforms, including stand-alone systems. As an alternative or addition, some or all of the components of system 100 can be implemented on client devices, such as through applications that operate on user terminals.

In some examples, system 100 can communicate over one or more networks, via one or more network interfaces (e.g., wirelessly or using a wireline), to communicate with one or more transit devices 160. A transit device 160 can correspond to a mobile computing device that can, during performance of the transport service, provide location data to system 100. In variations, the transit device 160 can correspond to a mobile computing device that is operated by a service provider and/or associated with a vehicle of the service provider providing a transport service, or a mobile computing device that is operated by a customer, such as a passenger who is riding in the vehicle as the transport service is being performed. The one or more networks can include the Internet, wireless local area networks (WLANs), cellular networks, or other networks for enabling communication between devices.

System 100 can operate with or as part of another system, such as a transport service system or delivery service system, which arranges transport or delivery between a requester and a service provider. As an example, a customer communicate with the service system over a network using a customer device in order to request a service, such as a transportation or delivery service (e.g., food delivery, messenger service, food truck service, or product shipping) or a mobile entertainment service (e.g., mariachi band, string quartet). The service system can then arrange for the service to be performed by a service provider, such as a driver, a food provider, a band, etc.

In one example, system 100 can include a roadway detection 110, a toll amount determination 120, a transit device interface 130, and one or more databases 140, 150, such as a transit model database and a toll database, respectively. The components of system 100 combine to determine that a vehicle, during performance of a transport or delivery service, has driven along a roadway in which a toll is to be assessed, and to determine the appropriate amount for the toll. The determined toll amount can be provided to the respective service system. In some variations, the components that are described in system 100 can be each provided as individual components or modules, or as part of other components. Logic can be implemented with various applications (e.g., software) and/or with hardware of one or more computing devices that implements system 100. In some implementations, the components of system 100 can be implemented on network side resources, such as on one or more servers. System 100 can also be implemented, at least in part, through other computer systems in alternative architectures (e.g., peer-to-peer networks, etc.).

As an alternative or addition, some or all of the components of system 100 can be implemented on client machines or devices, such as through applications that operate on the transit devices 160. For example, an application operating on a transit device 160 can execute to perform one or more of the processes implemented by one or more components of system 100.

System 100 can include a transit device interface 130 that can manage communications between system 100 and a plurality of transit devices 160. As discussed, a transit device 160 can correspond to a mobile computing device that is operated by a service provider or driver. In one implementation, a driver that is operating a transit device 160 can download an application that can be used to interface with the network service. Such an application can include or use an application programming interface (API), such as an externally facing API, to communicate device data 161 to the transit device interface 130. When a transport service has been arranged between a driver and a customer, for example, the driver can provide an input via the application to notify system 100 that the transport service has begun, and device data 161 corresponding to the performance of the transport service can be provided to the transit device interface 130 (e.g., periodically).

In some examples, the device data 161 can include location information, such as a plurality of location data points (e.g., latitudes and longitudes), that correspond to a route of travel of the driver's vehicle during performance of the transport service. As the vehicle progresses from a first location (e.g., a start location or pick-up location) to a second location (E.g., an end location, a destination location, or drop-off location), location or position information corresponding to its position can be provided as device data 161 to the transit device interface 130. For example, the transit device 160 can include a global positioning system (GPS) component for providing GPS data of its position at different instances in time. In one example, each location data point can include at least one of a latitude, a longitude, a time stamp, an error value, or a bearing. The error value can vary for each location data point depending on the quality of GPS signals and/or on the amount of signal interference near the transit device 160.

For example, once performance for a transport or delivery service begins, the transit device 160 can begin to provide a plurality of location data points to the transit device interface 130 periodically (e.g., every five or ten seconds). Using the plurality of location data points, system 100 (as well as the transport service or delivery service system) can determine detailed information about the current performance of the service (or past performance once the service has been completed). The plurality of location data points can provide information about the bearing of the vehicle (e.g., the vehicle is moving south from time, t=T1, to time, t=T2), the route that has been taken, as well as the speed in which the vehicle has traveled.

According to some examples, the device data 161 can also include information about the driver and the driver's vehicle. For example, for a particular service provider, the device data 161 can include an identifier of the service provider, the vehicle type driven by the service provider (e.g., town car, taxi cab, SUV, electric vehicle, shuttle, etc.), the vehicle capabilities or capacities, route information selected by the service provider, etc. In some example, the identifier of the service provider can be used by one or more components of system 100 to associate previously stored data (e.g., historical data) with the particular service provider in order to access additional information for that service provider. In addition, a vehicle type can be used by system 100 to determine the appropriate toll amount when the vehicle drives along a roadway in which a toll is to be assessed.

The transit device interface 130 can provide device data 131 that is received from one or more transit devices 160 to the roadway detection 110. The roadway detection 110 can use the device data 131 to determine whether a vehicle that is providing a transport service has potentially driven along a roadway in which a toll is to be assessed. Depending on implementation, a roadway in which a toll is to be assessed can include bridges, tunnels, turnpikes, etc., in which a driver of a vehicle can drive through in return for paying a sum of money (e.g., a toll amount). The roadway detection 110 can make a determination that the vehicle has potentially driven along a roadway in which a toll is to be assessed based on a set of location data points received from a transit device corresponding to or associated with the vehicle.

The roadway detection 110 can communicate with one or more databases, such as a transit model database 140, that stores one or more transit models or spatial databases. In some cases, the transit model database 140 can include a vehicle system spatial database, which is a queryable map database that identifies different points (e.g., having a latitude and a longitude, and/or an altitude) along paths of transit, such as roadways. The vehicle system spatial database can include information of how the points connect with other points (e.g., to indicate how roads intersect with one another, etc.). Some vehicle system spatial databases can also include points identifying locations of interests or landmarks.

The transit model database 140 can include points corresponding to locations on roadways, highways, freeways, etc., and other information related to roadways, such as intersections, one way streets, how the different roads and streets connect to each other, etc., as well as roadways, bridges, and tunnels in which a toll is to be assessed. In some examples, the transit model database 140 can identify a set of location data points that correspond to roadways (e.g., turnpikes, bridges, tunnels, etc.) in which a toll is to be assessed. Each of these roadways can be associated with a roadway identifier.

The roadway detection 110 can use map data 141 from the transit system spatial database 140 in order to determine whether the vehicle providing the transport service or delivery service has potentially driven along a roadway in which a toll is to be assessed. For example, the roadway detection 110 can search the transit system spatial database 140 for roadways in which a toll is to be assessed using one or more location data points 131 received from the transit device 160. The roadway detection 110 can receive a plurality of location data points 131 that identifies the route the vehicle has traveled during performance of the transport service, and determine whether there are any roadways in which a toll is to be assessed that are within a predetermined distance of the location data points. This predetermined distance can be adjusted or configured by an administrator of system 100 depending on some examples. If there are no such roadways within the predetermined distance or in a defined area of the plurality of location data points, the roadway detection 110 can communicate to the transport service system, for example, that no toll is to be assessed as part of the fare for the transport service. In this manner, no additional computation or processes need to be performed by system 100 to determine a toll amount. On the other hand, if one or more potential roadways are determined to be within a predetermined distance or a defined area of the plurality of location data points, the roadway detection 110 can then determine which roadway was most likely driven along by the vehicle.

In some examples, the roadway detection 110 can also determine whether the vehicle has potentially driven along a roadway in which a toll is to be assessed based on the loss of one or more location data points from the transit device 160. The transit device 160 can move to or be in an area where wireless signal capabilities (e.g., such as cellular signals and/or GPS signals) and/or network connectivity can be reduced or lost. This can be a result of signal interference, lack of cellular service, or other reasons. In such cases, one or more location data points 161 (e.g., location data points for a duration of time) may not be properly transmitted by the transit device 160, if at all, to the transit device interface 130. Loss of location data points 161 can sometimes indicate that the vehicle has driven through, for example, a tunnel or underground roadway in which wireless signal capabilities of a transit device 160 is diminished or lost. The roadway detection 110 can determine if and when there is a loss of location data points during the performance of the transport service, and using map data 141, can determine whether the vehicle has driven through a tunnel in which a toll is to be assessed.

If the roadway detection 110 determines that the vehicle has potentially driven along a roadway in which a toll is to be assessed, the roadway detection 110 then identifies which roadway was traveled. For example, given the set of location data points 131 received, the roadway detection 110 determines the most probable route taken by the vehicle. Typically, the location data points 131 of the transit device 160 can provide an accurate indication of the route traveled by the vehicle during performance of the transport service. The roadway detection 110 can use the location data points to determine whether they correspond to any particular roadways identified in the transit model database 140 as being a roadway in which a toll is to be assessed.

For example, in some situations where there is only one potential roadway within a predefined distance of one or more location data points (or within a particular region), the roadway detection 110 can compare one or more location data points of the set of received location data points 131 with one or more location points corresponding to the potential roadway (e.g., determined from the map data 141). If one or more location data points (or set of location data points) of the transit device 160 substantially matches the location data point(s) of the potential roadway (e.g., a location point of the transit device is within a predefined distance of a location point of the potential roadway), then the roadway detection 110 identifies that roadway as being the roadway driven along by the vehicle. On the other hand, if there is no substantial match, the roadway detection 110 can determine that the vehicle did not drive along the potential roadway in which a toll is to be assessed, and can communicate to the transport service system that no toll is to be assessed as part of the fare for the transport service.

In other situations, there can be multiple roadways in a given area in which a toll is to be assessed. For example, in metropolitan areas or large cities (e.g., such as Boston, Mass.), there can be two or more tunnels in a given geographic region that have tunnel entrances/exits close to each other. The roadway detection 110 identifies which tunnel, from the two or more potential tunnels, was most likely taken by the vehicle during performance of the transport service. In either case, the roadway detection 110 uses one or more location data points 131 received from the transit device 160 in order to identify the roadway in which the toll is to be assessed that was traveled by the vehicle.

According to some examples, the roadway detection 110 can receive inaccurate location data point(s) and/or does not receive location data points provided by transit device 160 for a duration of time (e.g., GPS points are not received by the roadway detection 110 for a duration of one minute). For example, when the vehicle is driven along a street towards an underground tunnel, the location data points 131 provided by the transit device 160 can become less accurate (e.g., have a higher error value) as a result of the vehicle starting to travel underground. In addition, once the vehicle is driving through the tunnel, location data points may not be provided to the roadway detection 110 (e.g., due to a loss of signal). In such cases, the roadway detection 110 can use a set of location data points each having a high confidence ranking (e.g., each having an error amount that is less than a predefined error threshold) and the map data 141, and extrapolate additional location data points to determine the most probable route taken by the vehicle.

In one example, the roadway detection 110 can first discard or remove one or more location data points (that have been received from the transit device 160) having a low confidence ranking. A location data point can have a low confidence ranking if the error amount of that location data point (e.g., the error amount of the particular GPS reading) is greater than or equal to a predefined error threshold amount. Such location data points are determined to be inaccurate so that they are not relied upon for identifying the tunnel in which the vehicle has driven through. Using the remaining set of location data points and the map data 141 that identifies roadways, streets, freeways, etc., the roadway detection 110 can extrapolate additional location data points to fill in the gap(s) of lost location data points (e.g., include location data points with already received location data points).

For example, the roadway detection 110 can use a routing engine, a physics engine, and/or a hidden Markov model solver (or other models) to select, from all (or many of) the possible paths of travel, a path of travel as being the most likely path of travel for the vehicle between a first location data point and a second location data point, where location data points are missing in between. Using information corresponding to the remaining set of location data points (after removing or deleting location data points of low confidence) and using the map data 141 (e.g., map data of streets, roadways, tunnels in a proximate geographic region of the vehicle), a routing engine and/or the physics engine, for example, can use the time stamps of the location data points, the bearing information, etc., to generate one or more additional data points to fill in between the first location data point and the second location data point. In this manner, the roadway detection 110 can have a more comprehensive set of data that better indicates the most probable route taken by the vehicle even with receipt of inaccurate location data points and/or loss of location data. The roadway detection 110 can then use the location data points 131 received from the transit device 160 and extrapolated data in order to identify the tunnel in which the toll is to be assessed.

In some implementations, the roadway detection 110 can also use historical data and/or extrapolated data of a service provider's previously driven routes to identify the roadway in which the toll is to be assessed. Historical data and/or extrapolated data of a service provider's previously driven routes can be stored in one or more data stores that are accessible by system 100. In many cases, a particular service provider can perform a service numerous times by taking the same routes from a starting region to a destination region. For example, a driver can take the same tunnel that charges a toll instead of taking another route or another tunnel in a given geographic region. The information corresponding to the driver's previous routes can be stored in a database and associated with the particular driver, and accessed by the roadway detection 110. In one example, the roadway detection 110 can receive, as part of the device data 131, the identification of the driver and/or the transit device of the driver, and perform a look up of the driver's previously driven routes from the driver database. In this manner, the roadway detection 110 can use such information to better determine the most likely route or tunnel taken by the driver in situations where data extrapolation is necessary (e.g., when there is a loss of accurate location data points for a duration of time). For example, the driver "John" is driving and has taken Tunnel A around this time of day the last five or ten times. This type of information can be indicative that John, in a similar situation, will also more likely take Tunnel A instead of another tunnel.

Once the roadway is identified by the roadway detection 110, a roadway identifier (ID) 111 corresponding to the identified roadway can be provided to the toll amount determination 120. In some examples, the transit model database 140 can identify roadways in which a toll is to be assessed (e.g., associate a set of location data points that correspond to such roadways with a roadway identifier). The toll amount determination 120 can use the roadway ID 111 to perform a search or lookup in a toll database 150 to determine the appropriate amount for the toll 151 for the identified roadway. The toll database 150 can include entries of roadway IDs and their corresponding amounts for the toll. In one implementation, one roadway ID can have two or more corresponding toll amounts (e.g., a first toll amount for travel in one direction, a second toll amount for travel in another direction). In some cases, a first toll amount can be zero (e.g., if a tunnel or bridge has a toll for only one direction of travel), while a second toll amount is greater than zero (e.g., five dollars). After retrieving the toll amount 151, the toll amount determination 120 can provide the toll amount 151 to a transport service system, e.g., to include as part of the fare for the transport service.

According to examples, the roadway detection 110 can also provide location data 113 to the toll amount determination 120. The location data 113 can include one or more location data points of the transit device 160 and/or a direction/bearing of the transit device when the vehicle drove along the roadway in which a toll is to be assessed (e.g., from east to west). Because some roadways assess a toll amount for one direction and not another, or different amounts for different directions, the toll amount determination 120 can use the location data 113 to determine the toll amount for an identified roadway based on the direction of travel of the vehicle. In this manner, the toll amount determination 120 can precisely determine the appropriate amount for the toll to include as part of the fare for the transport service.

In one example, the toll determination 120 can also receive information about the type of vehicle that is driven by the service provider. In some situations, a toll amount can vary depending on the type of vehicle that is driven along or through the roadway. For example, a tunnel can charge more for an SUV using the tunnel as compared to a sedan or an electric vehicle. Based on the type of vehicle, the toll determination 120 can determine the appropriate toll amount 151 for the tunnel or bridge.

The toll amount determination 120 provides the toll amount 151 to a transport service system to include as part of the fare for the transport service. The transport service system can include the fare when charging the customer for the provided transport service. In some examples, the transport service system can also provide the toll amount 151 to the customer and/or service provider's device over the network (e.g., as a message or through an application that operates on the respective device). As some city and/or state regulations mandate that toll amounts can only be charged to a customer if the amount is accurate (e.g., for a transport service), system 100 provides a method to precisely determine the correct amount for a toll for a transport or delivery service system so that the service provider can receive fair compensation for performing the service.

System 100 can determine the appropriate amount for a toll during performance of the transport or delivery service (e.g., as location data points are received). As an addition or an alternative, system 100 can determine the appropriate amount for the toll after the transport service has been completed. For example, one or more components of system 100 can perform processes or methods described during performance of the transport service (e.g., in real time or close to real time) and/or after receiving an indication from a transit device 160 that performance has been completed (e.g., within five minutes of completion). Because a customer does not necessarily have to be charged immediately upon completion of the service, system 100 can determine the amount for a toll (if necessary) in response to completion of the service.

In addition, some implementations provide that the databases described with system 100 can be maintained, controlled, and updated by an administrator or user of system 100 (and/or the transport or delivery service system). In some instances, changes to data may be necessary, e.g., if a toll amount changes, or if new roadways in which a toll is to be assessed is created. System 100 may also include a plurality of vehicle system spatial databases 140 and/or a plurality of toll databases 150 for different geographic areas or areas, such as different cities, states, countries, etc. For example, the toll databases 150 can have entries for roadways and corresponding toll amounts based on the countries the roadways reside in, so that the toll amounts are provided with appropriate currencies.

Methodology

Figure 2:
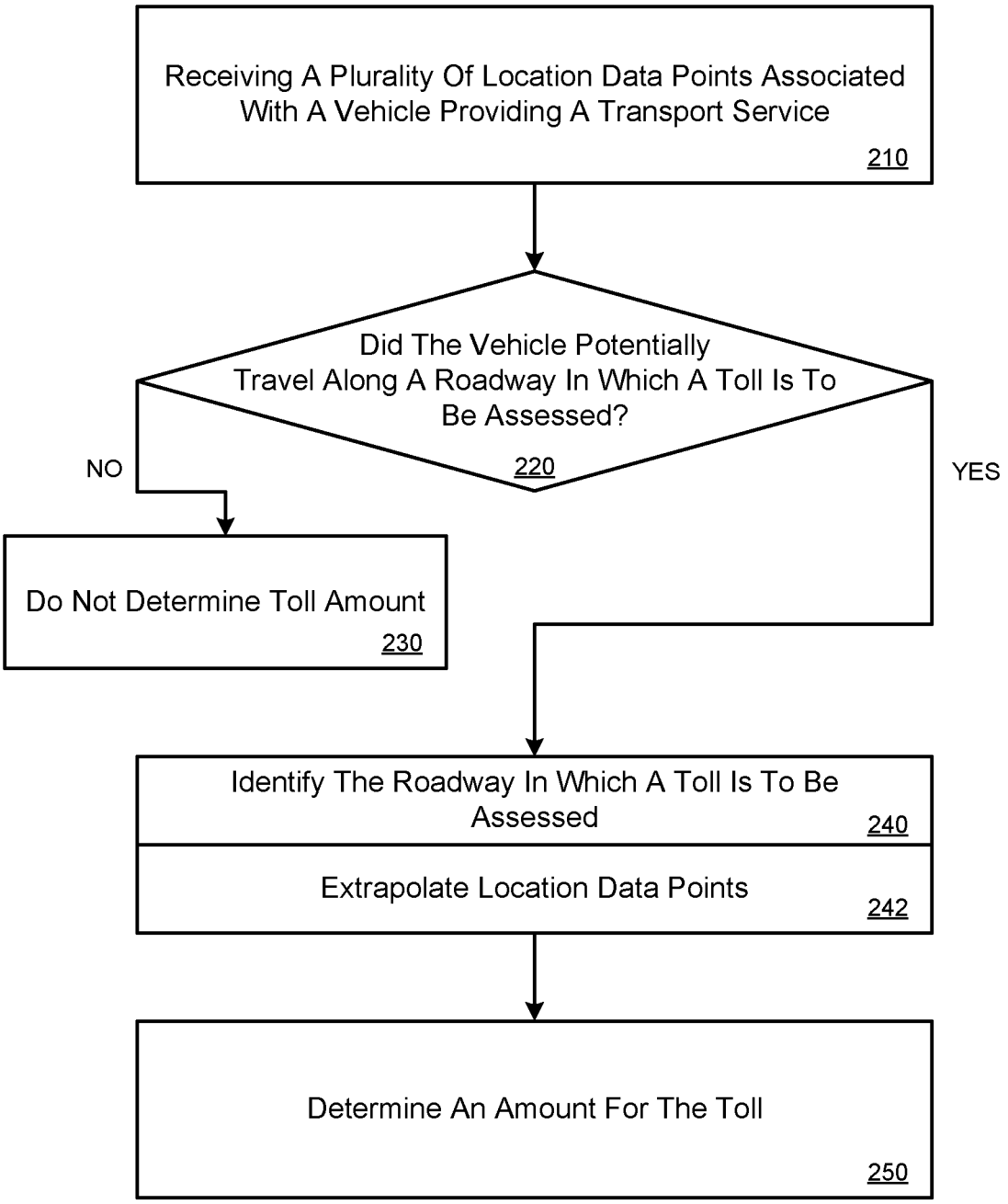
FIG. 2 illustrates an example method for determining an amount for a toll for a transport service.

FIG. 2 illustrates an example method for determining an amount for a toll for a transport service. A method such as described by FIG. 2 can be implemented using, for example, a system and components such as described with FIG. 1. Accordingly, references made to elements of FIG. 1 are for purposes of illustrating a suitable element or component for performing a step or sub-step being described. For illustrative purposes, FIG. 2 is described with respect to a vehicle for a transport service that has driven through a tunnel in which a toll is to be assessed.

A tolling system, such as system 100 of FIG. 1, receives a plurality of location data points (e.g., GPS points) from a transit device that is associated with a vehicle that provides a transport service (210). The transit device can be a computing device of a service provider and can be associated with the service provider's vehicle. Once performance of the transport service is initiated, the transit device can transmit location data points corresponding to the route of travel to system 100 over one or more networks (e.g., periodically).

The roadway detection 110 can make a determination whether the vehicle has potentially traveled along a roadway (or tunnel) in which a toll is to be assessed (220). The roadway detection 110 can make this determination based, at least in part, on a set (e.g., one or more) of location data points of the received plurality of location data points. The roadway detection 110 can use map data from a vehicle system spatial database to determine whether the vehicle is driving in a region where there are such roadways or tunnels. If there is no potential tunnel (having a toll) in the vicinity (e.g., within a predetermined distance from one or more location data points of the transit device), the roadway detection 110 determines that the vehicle did not drive along a potential roadway or tunnel in which a toll is to be assessed (230). For example, the transport service may have been provided within a small area (e.g., only ten blocks from a start location to a destination location) or in a town where no tunnels (or other roadways) in which a toll is to be assessed exist. In such cases, system 100 can converse resources and not perform additional processing to determine an amount for a toll.

However, if a tunnel is determined to be within a predetermined region based on the map data and the set of location data points of the transit device (e.g., there is a likelihood that the vehicle may have driven through a tunnel), the roadway detection 110 can determine that the vehicle has potentially driven through a tunnel in which a toll is to be assessed. The roadway detection 110 can identify the tunnel that the vehicle has driven through by using the map data and/or processing the location data points received from the transit device (240). The roadway detection 110 can use or reference a map database to identify a set of location data points that correspond to roadways (e.g., turnpikes, bridges, tunnels, etc.) in which a toll is to be assessed.

In many cases, when a vehicle drives through an underground tunnel, the transit device can lose service, such as a cellular service. As a result, one or more location data points may not be received by the roadway detection 110. In addition, there may be location data points that are inaccurate and have a high error amount (e.g., in situations where the vehicle approaches the tunnel and begins to go underground, or as the vehicle is exiting the tunnel). The roadway detection 110 can remove or discard one or more location data points having a low confidence ranking (e.g., have a high error amount greater than a user-configurable threshold error amount), and perform additional processing to determine the most probable route taken by the vehicle.

Figure 3:
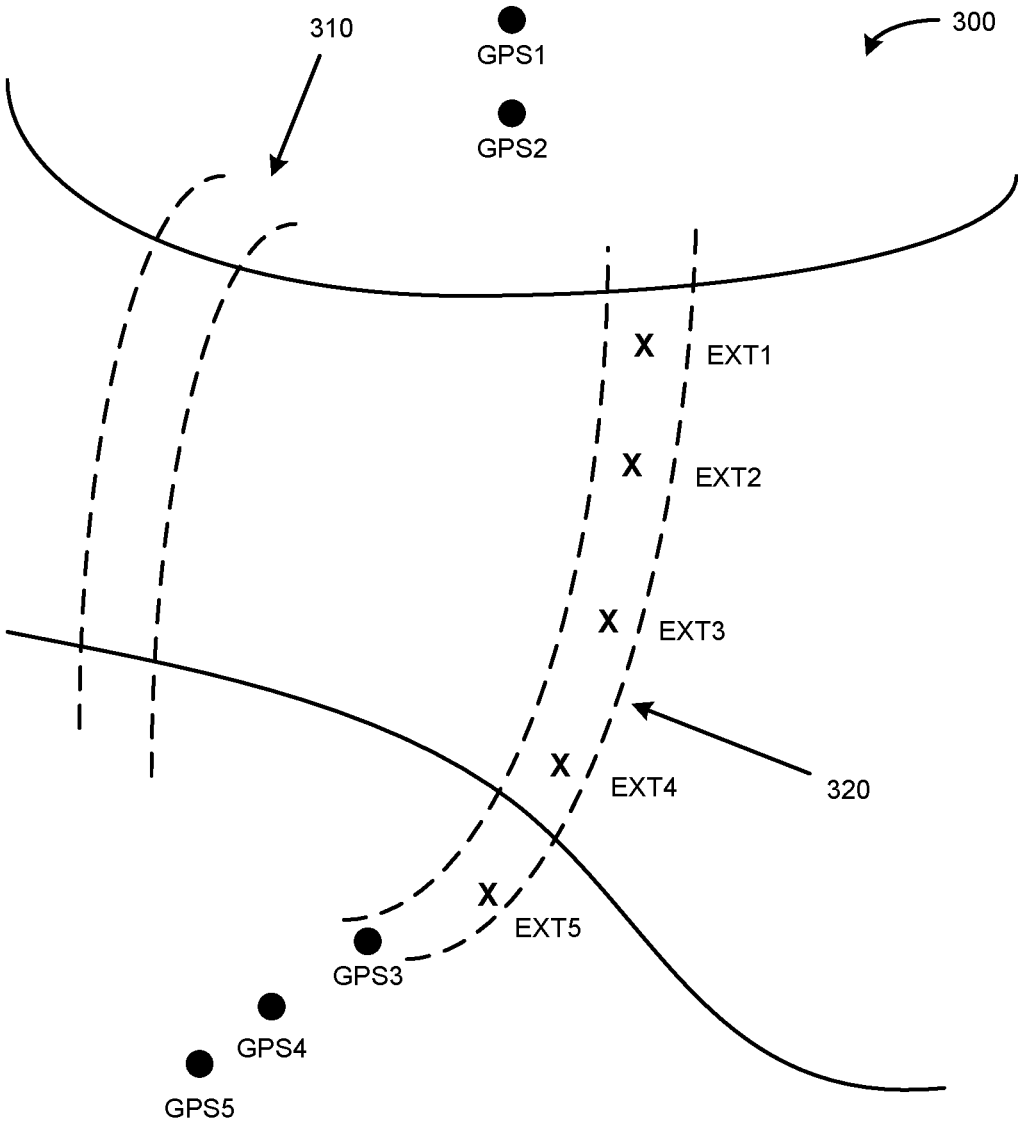
FIG. 3 is an example diagram illustrating how a tolling system identifies a tunnel using location data points.

In one example, the roadway detection 110 can extrapolate additional location data points to add to the received location data points to generate a more complete representation of the route of travel by the vehicle (242). Using the extrapolated location data points and the received location data points (and excluding the location data points removed or discarded), the roadway detection 110 can identify the tunnel traveled through by the vehicle. For example, FIG. 3 is an example diagram illustrating how a tolling system identifies a tunnel using location data points.

The diagram 300 illustrates a first tunnel 310 and a second tunnel 320 spanning underground between two geographic regions. In one example, the diagram 300 can be illustrative of a metropolitan area where multiple tunnels can exist in a particular area. As the vehicle travels during performance of the transport service, e.g., along a street or highway, etc., location data points can be provided to system 100. The transit device corresponding to the vehicle provides a first location data point, GPS1, at time t=t1, and then a second location data points, GPS2, at a later time after the first time, t=t2 (ten seconds after t1). After receiving GPS2, system 100 does not receive a location data point, GPS3, until time t=t3, (sixty seconds after t1). This can be a result of the transit device being underground so that no wireless or network connectivity was possible to transmit location data to system 100. The transit device then provides GPS4, and GPS5 at times t=t4 (seventy seconds after t1) and t=t5 (eighty seconds after t1), respectively.

The roadway detection 110 can determine whether one or more location points have a low confidence ranking based on their error amounts. In this case, each of the received five location points have a high confidence ranking (e.g., is above a threshold error amount), so no points are discarded or removed. However, because there are two tunnels within the given region, the first tunnel 310 and the second tunnel 320, the roadway detection 110 can extrapolate additional data points to identify which tunnel the vehicle drove through. Based on the set of received location data points and map data (which include location information of the tunnels 310, 320 in the region), the roadway detection 110 can use a routing engine, a physics engine, and/or a hidden Markov model solver to extrapolate the most likely path of travel to fill in the gaps between the location data points. In the example described, five additional location data points are determined (EXT1 through EXT5) and included with the representation. The roadway determination 110 can then identify that the vehicle most likely drove through the second tunnel 320 during performance of the transport service.

Figure 4A:
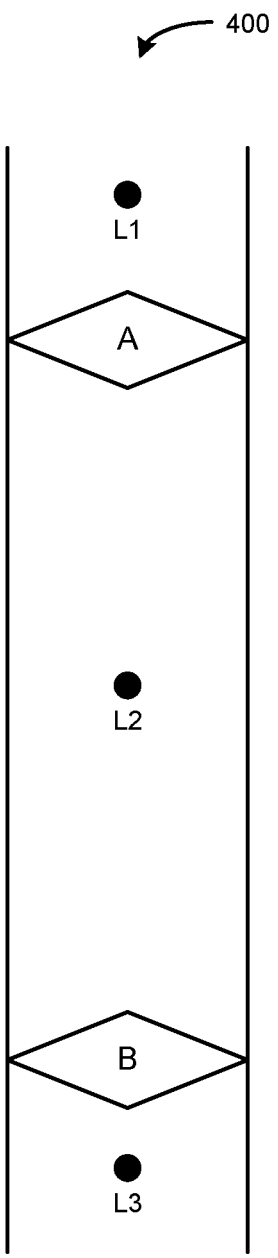
FIGS. 4A and 4B are example diagrams that illustrate how a tolling system determines an amount for a toll.
Figure 4B:
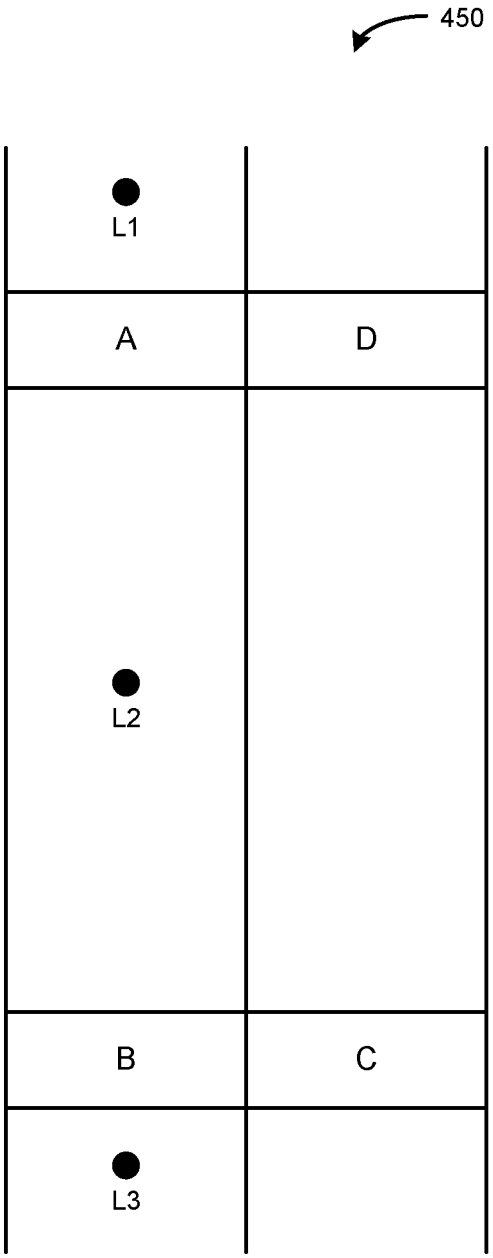

Once the roadway or tunnel is identified, system 100 determines an amount for the toll (250). The toll amount determination 120 can use an ID of the identified tunnel to lookup the appropriate amount for the toll from a toll database. In addition, in some examples, the toll amount determination 120 can also use location data corresponding to a route of travel of the vehicle to determine the amount for the toll (e.g., in some cases, different toll amounts can be assigned based on the direction of travel through a tunnel). This location data can be used with the stored data in the toll database to determine the amount based on the bearing or direction of travel of the vehicle. For example, FIGS. 4A and 4B are example diagrams that illustrate how the toll amount determination 120 can determine an amount for a toll.

The toll amount determination 120 can determine an amount for a toll based on the direction that the vehicle traveled. In FIG. 4A, diagram 400 illustrates how a toll amount is associated with a roadway or tunnel in a toll database, such as the toll database 150 of FIG. 1. For example, for a tunnel or bridge in which a toll is assessed in only one direction, two polygons are shown, polygon A and polygon B. There is a toll for such a roadway only when the vehicle travels in the direction from A to B (not from B to A). The location data L1 at time t=t1, L2 at time t=t2, and L3 at time t=t3, can indicate that the vehicle moved from L1 to L2 to L3 through the tunnel. Because the location data indicates that the vehicle crossed the polygons A and then B, in that order, the toll amount determination 120 can determine the toll for that tunnel. In this manner, even if the tunnel ID matches a tunnel in the toll database 150, there may be no toll amount (e.g., if the vehicle drove from polygon B to polygon A instead).

If a roadway assesses the same toll amount in either direction, the toll database 150 can indicate a single toll amount associated with a single polygon, for example, instead of two polygons. Whenever the location data indicates that the vehicle drove through the polygon (e.g., a location data point along the roadway or tunnel), the amount can be determined. Similarly, in FIG. 4B, diagram 450 is another example that illustrates how a first toll amount can be associated with a first direction of travel through a tunnel (polygon A to polygon B), and a second toll amount can be associated with a second or opposing direction of travel through the tunnel (polygon C to polygon D).

Hardware Diagram

Figure 5:
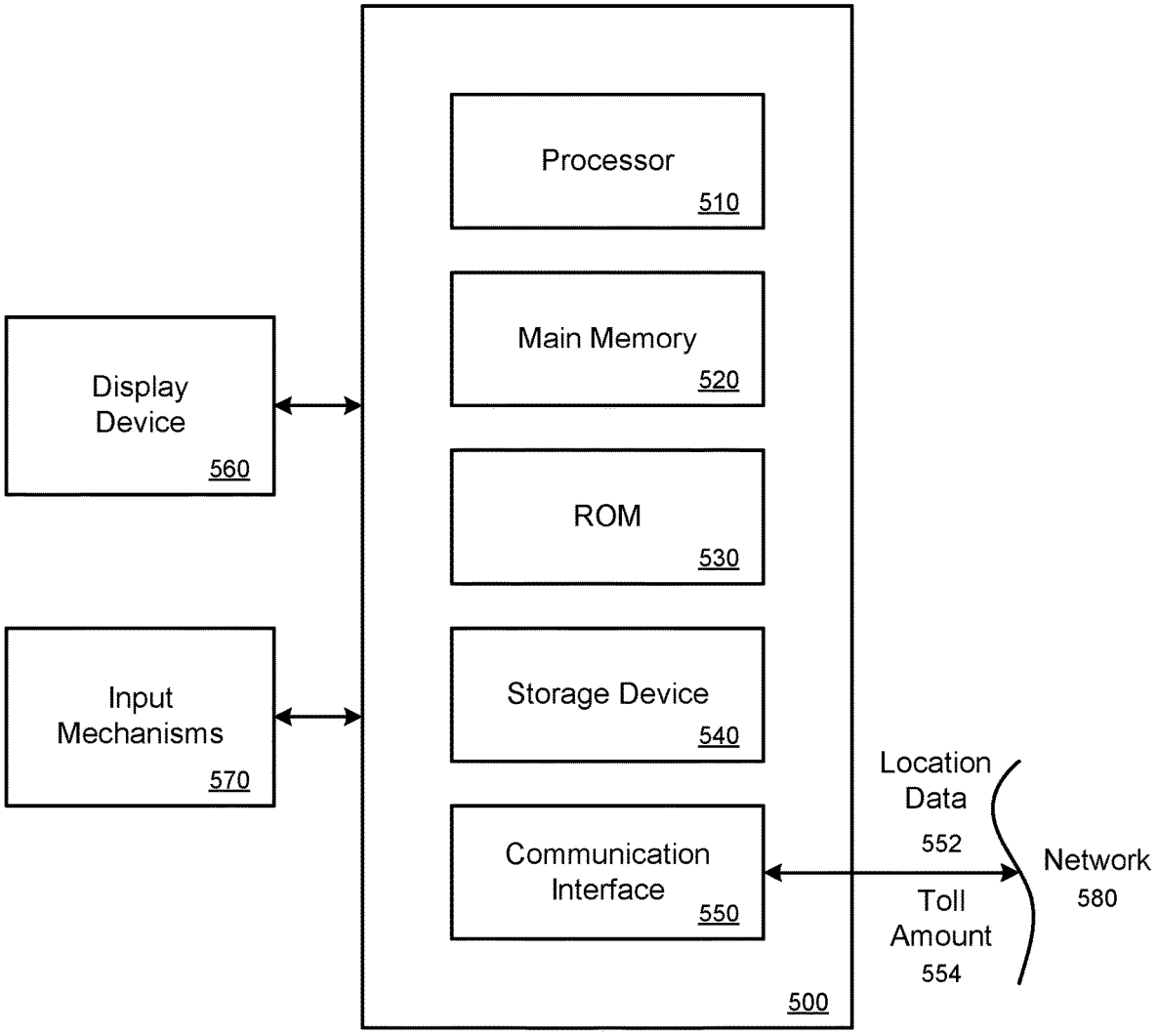
FIG. 5 is a block diagram that illustrates a computing device upon which examples described herein may be implemented.

FIG. 5 is a block diagram that illustrates a computing system upon which examples described herein may be implemented. For example, in the context of FIG. 1, system 100 may be implemented using a computer system (or a combination of computer systems) such as described by FIG. 5.

In one implementation, computer system 500 includes processor 510, main memory 520, ROM 530, storage device 540, and communication interface 550. Computer system 500 includes at least one processor 510 for processing information. Computer system 500 also includes a main memory 520, such as a random access memory (RAM) or other dynamic storage device, for storing information and instructions to be executed by the processor 510. Main memory 520 also may be used for storing temporary variables or other intermediate information during execution of instructions to be executed by processor 510. Computer system 500 may also include a read only memory (ROM) 530 or other static storage device for storing static information and instructions for processor 510. A storage device 540, such as a magnetic disk or optical disk, is provided for storing information and instructions.

The communication interface 550 may enable the computer system 500 to communicate with one or more networks 580 through use of the network link (wireless or wireline). Using the network link, computer system 500 can communicate with other computer systems (e.g., such as one or more computer systems that operate and provide a transport service system) and one or more customer devices, such as a mobile computing device. For example, the computer system 500 can receive location data 552 from a customer device and/or a service provider device to determine whether the vehicle has driven through a tunnel or along a roadway in which a toll is to be assessed as part of the transport service. In addition, the computer system 500 can provide, over the one or more networks 580, a determined toll amount 554 to the transport service system and/or to a mobile computing device of a customer and/or a service provider (such as described with FIGS. 1 and 2).

Computer system 500 can include a display device 560, such as a cathode ray tube (CRT), a LCD monitor, or a television set, for example, for displaying graphics and information to a user. An input mechanism 570, such as a keyboard that includes alphanumeric keys and other keys, can be coupled to computer system 500 for communicating information and command selections to processor 510. Other non-limiting, illustrative examples of input mechanisms 570 include a mouse, a trackball, touch-sensitive screen, or cursor direction keys for communicating direction information and command selections to processor 510 and for controlling cursor movement on display 560. While only one input mechanism 570 is depicted in FIG. 5, different variations may include any number of input mechanisms 570 coupled to computer system 500.

Examples described herein are related to the use of computer system 500 for implementing the techniques described herein. According to one example, those techniques are performed by computer system 500 in response to processor 510 executing one or more sequences of one or more instructions contained in main memory 520. Such instructions may be read into main memory 520 from another machine-readable medium, such as storage device 540. Execution of the sequences of instructions contained in main memory 520 causes processor 510 to perform the process steps described herein. For example, processor 510 can execute instructions to receive location data 552 during performance of a transport service, determine that the service provider has potentially driven through a tunnel in which a toll is to be assessed, and identify the tunnel. In alternative examples, hard-wired circuitry may be used in place of or in combination with software instructions to implement examples described herein. Thus, examples described are not limited to any specific combination of hardware circuitry and software.

It is contemplated for examples described herein to extend to individual elements and concepts described herein, independently of other concepts, ideas or system, as well as for examples to include combinations of elements recited anywhere in this application. Although examples are described in detail herein with reference to the accompanying drawings, it is to be understood that the examples are not limited to those precise descriptions and illustrations. Accordingly, it is contemplated that a particular feature described either individually or as part of an example can be combined with other individually described features, or parts of other examples, even if the other features and examples make no mentioned of the particular feature.

What is being claimed is:

1. A method for remotely determining a route of a vehicle driven by a driver in connection with a transport service, the method being performed by a network-side computing system and comprising:

arranging a transport service that is provided by the driver for a customer, the driver associated with a driver computing device that includes wireless signal capabilities;

receiving a plurality of location data points from the driver computing device as the transport service is being provided;

while the transport service is being provided and the wireless signal capabilities of the driver computing device are not diminished, determining a route of the vehicle from the plurality of location data points;

determining, for each of the plurality of location data points, an error amount that is indicative of a degree of accuracy of the location data point;

determining that one or more of the plurality of location data points received from the driver computing device includes an error amount which exceeds an error threshold;

detecting that the wireless signal capabilities of the driver computing device are diminished responsive to determining that the one or more of the plurality of location data points includes an error amount that exceeds the error threshold;

responsive to the wireless signal capabilities of the driver computing device being diminished:

A) automatically extrapolating a portion of the route of the vehicle that corresponds to the wireless signal capabilities of the driver computing device being diminished using (i) one or more of the plurality of location data points having error amounts below the error threshold that is indicative of a high confidence ranking of the one or more of the plurality of location data points that were received before the wireless signal capabilities of the driver computing device were diminished; and (ii) at least one of a bearing or time stamp which was obtained, by the network-side computing system, with or from the one or more of the plurality of location data points of the high confidence ranking; and B) determining a path from a plurality of possible paths the driver is taking during the route based on the extrapolated portion of the route; and C) calculating a fare for the customer based on the determined path, the fare including a toll associated with the extrapolated portion of the route.

2. The method of claim 1, wherein each of the plurality of possible paths is associated with a different toll and calculating the fare comprises:

calculating the fare based at least in part on the toll associated with the determined path.

3. The method of claim 1, wherein determining the path comprises:

determining one or more of the plurality of location data points that are within a predetermined distance of a corresponding roadway; and selecting the corresponding roadway as the path taken during the route.

4. The method of claim 1, wherein the toll includes a tolling amount for at least one of a bridge, a turnpike, or a tunnel.

5. The method of claim 2, wherein calculating the fare comprises:

identifying an amount for an entry point taken by the vehicle on the determined route.

6. A system for remotely determining a route of a vehicle driven by a driver in connection with a transport service, the system comprising:

one or more network resources to communicate with devices over one or more networks;

one or more processors; and one or more memory resources storing instructions that are executable by the one or more processors, the instructions, when executed, causing the system to perform operations comprising:

arranging a transport service that is provided by the driver for a customer, the driver associated with a driver computing device that includes wireless signal capabilities;

receiving a plurality of location data points from the driver computing device as the transport service is being provided;

while the transport service is being provided and the wireless signal capabilities of the driver computing device are not diminished, determining a route of the vehicle from the plurality of location data points;

determining, for each of the plurality of location data points, an error amount that is indicative of a degree of accuracy of the location data point;

determining that one or more of the plurality of location data points received from the driver computing device includes an error amount which exceeds an error threshold;

detecting that the wireless signal capabilities of the driver computing device are diminished responsive to determining that the one or more of the plurality of location data points includes an error amount that exceeds the error threshold;

responsive to the wireless signal capabilities of the driver computing device being diminished:

A) automatically extrapolating a portion of the route of the vehicle that corresponds to the wireless signal capabilities of the driver computing device being diminished using (i) one or more of the plurality of location data points having error amounts below the error threshold that is indicative of a high confidence ranking of the one or more of the plurality of location data points that were received before the wireless signal capabilities of the driver computing device were diminished; and (ii) at least one of a bearing or time stamp which was obtained with or from the one or more of the plurality of location data points of the high confidence ranking; and B) determining a path from a plurality of possible paths the driver is taking during the route based on the extrapolated portion of the route; and C) calculating a fare for the customer based on the determined path, the fare including a toll associated with the extrapolated portion of the route.

7. The system of claim 6, wherein each of the plurality of possible paths is associated with a different toll and calculating the fare comprises:

calculating the fare based at least in part on the toll associated with the determined path.

8. The system of claim 6, wherein determining the path comprises:

determining one or more of the plurality of location data points that are within a predetermined distance of a corresponding roadway; and selecting the corresponding roadway as the path taken during the route.

9. The system of claim 6, wherein the toll includes a tolling amount for at least one of a bridge, a turnpike, or a tunnel.

10. The system of claim 7, wherein calculating the fare comprises:

identifying an amount for an entry point taken by the vehicle on the determined route.

* * * * *